United States Patent [19]

Roggenburg, Jr. et al.

[11] Patent Number: 4,478,356

[45] Date of Patent: Oct. 23, 1984

[54] FLEXIBLE-BAG SELF-CLOSING METERING DISPENSING VALVE

[75] Inventors: Stanley L. Roggenburg, Jr., Staten Island, N.Y.; Robert H. Laauwe, Franklin Lakes, N.J.

[73] Assignee: Essex Chemical Corporation, Clifton, N.J.

[21] Appl. No.: 391,846

[22] Filed: Jun. 24, 1982

[51] Int. Cl.[3] ..... B65D 35/22; B05B 11/04

[52] U.S. Cl. ..... 222/94; 222/207; 222/212; 222/494

[58] Field of Search ..... 222/180, 181, 185, 206, 222/207, 212, 213, 215, 424.5, 425, 449, 491, 494, 386.5, 92, 94, 495, 521

[56] References Cited

U.S. PATENT DOCUMENTS

| | | | |
|---|---|---|---|
| 2,329,917 | 9/1943 | Lautmann | 221/76 |
| 3,994,393 | 11/1976 | Nilson | 206/277 |
| 4,153,185 | 5/1979 | Nilson | 222/212 |
| 4,226,342 | 10/1980 | Laauwe | 222/494 |

*Primary Examiner*—Joseph J. Rolla
*Assistant Examiner*—Michael S. Huppert
*Attorney, Agent, or Firm*—Kenyon & Kenyon

[57] ABSTRACT

A flexible-bag self-closing metering dispensing valve for a flexible bag containing a fluid product, has a collapsible dome with an entrance for the product, and a valve seat supported by spokes, below which a diaphragm is positioned with a hole having a periphery seated on the valve seat. The spider and seat and the diaphragm are mounted so they cannot be driven out by sudden depression of the collapsible dome.

3 Claims, 7 Drawing Figures

Figure 1:
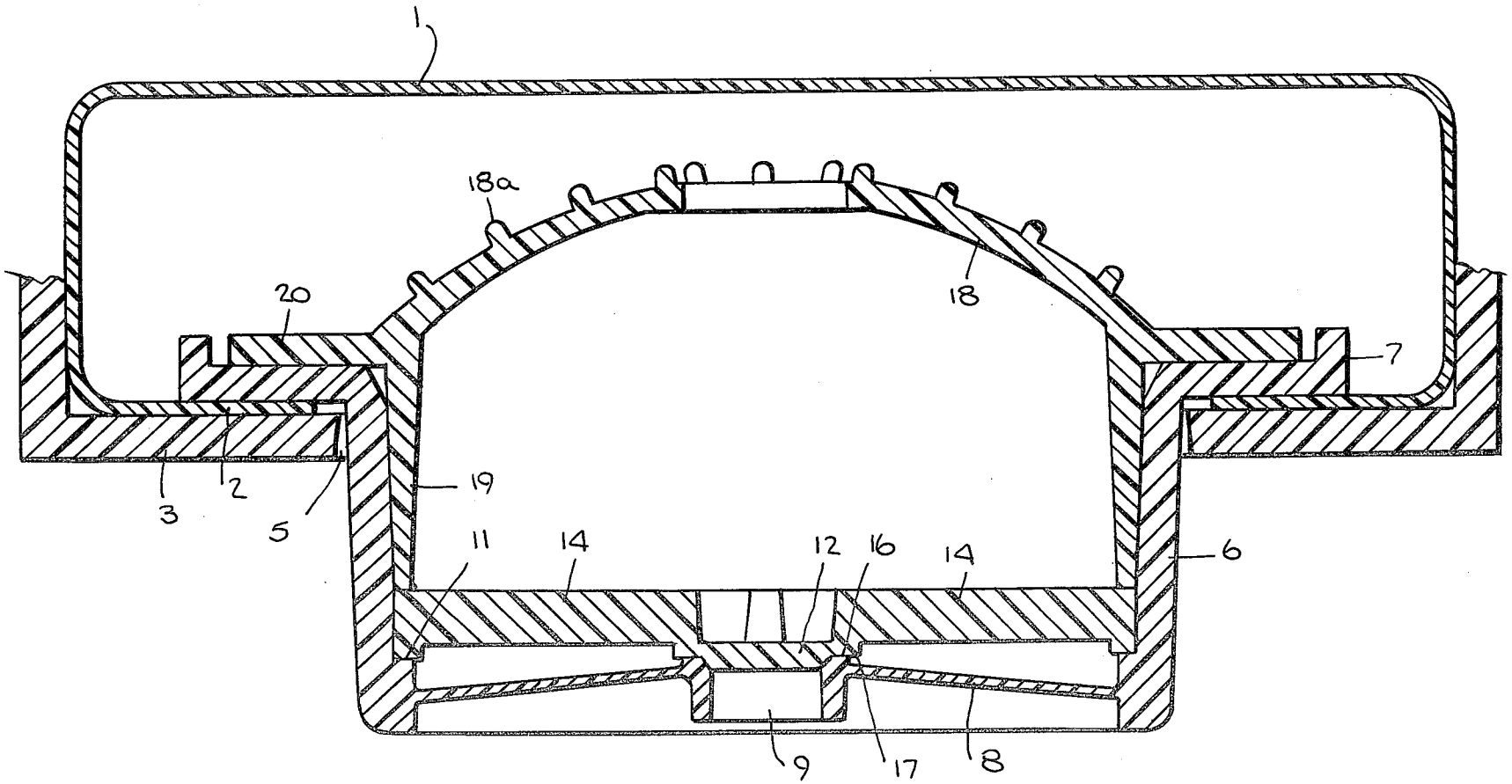

Fig. 3.
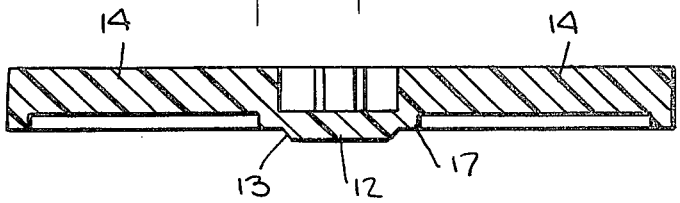
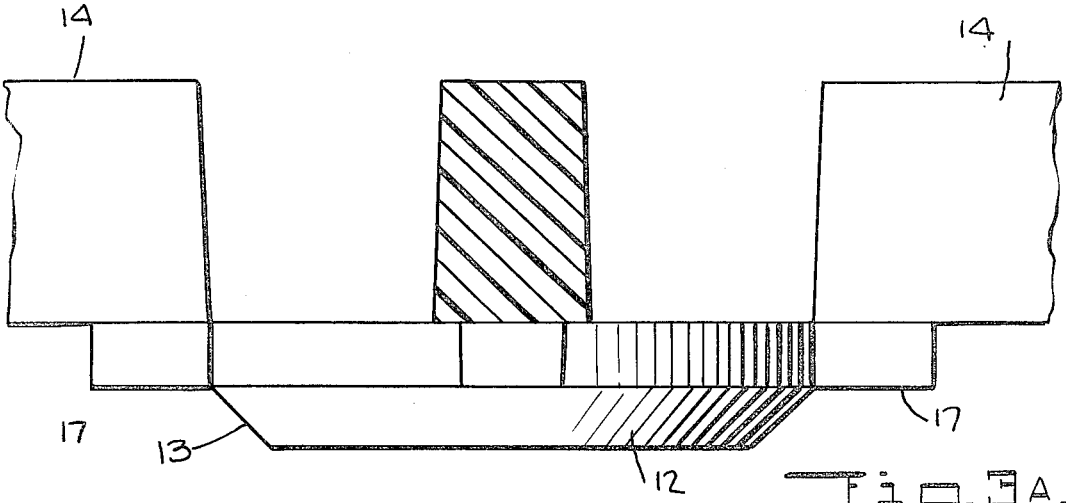
Fig. 3A.
Fig. 3B.
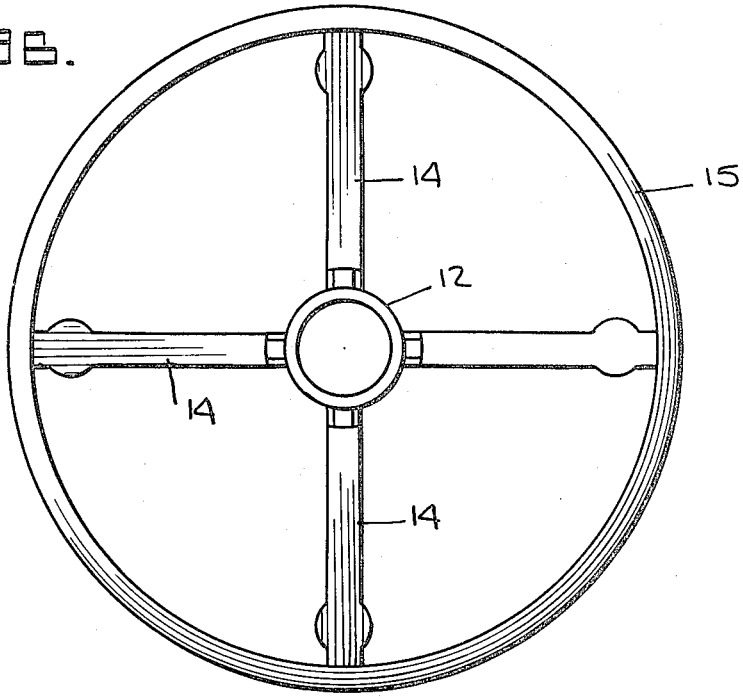

FLEXIBLE-BAG SELF-CLOSING METERING DISPENSING VALVE

Soft Soap for personal use is sold in a flexible bag which is hung with a lower portion folded horizontally with its lower wall on a rigid supporting surface and provided with a self-closing metering dispensing valve. Downward force on the upper wall causes the valve to open and dispense a metered shot of soap.

The above bag is illustrated by the Nilson U.S. Pat. No. 4,149,633.

The self-closing valve disclosed by the Laauwe and Roggenburg U.S. Pat. No. 4,226,342 has been made and sold by the millions and used entirely successfully on squeeze bottles containing soft soap.

The object of the present invention is to provide a metering self-closing dispensing valve applicable to the lower wall of the horizontal portion of the described type of soft soap bag and which enjoys the advantages of the patented valve of the above mentioned patent.

Briefly summarized, the valve of the present invention comprises a substantially cylindrical body having a flange extending radially from its upper portion and adapted to be sealed, as by heat sealing, to the lower wall of the horizontal bag portion around its hole provided for a valve, with the body depending from this lower wall. The characteristic circular wafer of the patented valve has its conical periphery facing downwardly and positioned on and normal to the body's axis by spokes connected to the wafer's top and extending radially to and connecting with the inside of the body below its upper portion via a solid annular supporting ledge on the body's inside. The equally characteristic deflectable diaphragm is positioned below the wafer and spokes by having its outer periphery solidly connected to the inside of the body with its central hole forming the conical periphery, in this case facing upwardly, and which is normally seated on the wafer's periphery by the diaphragm. An elastically collapsible dome closes the top of the body and centrally has a normally open hole through which the soft soap can flow.

In use, finger pressure applied to the upper wall of the horizontal bag portion presses this upper wall downwardly so it closes the dome's hole and collapses the dome. The space between the dome and the diaphragm forms a metering space containing a shot of the soft soap which when pressurized by the downward collapse of the dome, applies pressure to the diaphragm with consequent unseating of its hole's periphery from the wafer's periphery so as to effect the dispensing action. Another shot requires release of the pressure on the mentioned upper wall so that the dome can return upwardly via its elasticity, the soft soap flowing through the dome's open hole and filling the metering space by a combination of gravity force and suction resulting from the dome's elastic return from its displacement. The diaphragm positively reseats its hole's periphery on the wafer's periphery and forms a fluid-tight seal when the fluid pressure in the valve's metering space ends.

This new valve can be made entirely from three easily assembled injection-molded plastic parts with its operational effectiveness assured by the success of the Laauwe and Roggenburg patented valve. The valve heretofore used also used a dome above a diaphragm to form a metering space but did not incorporate the principles of the Laauwe and Roggenburg patent. This prior art valve, when in service, has failed to positively reclose after use, and if the upper bag wall is pressed downwardly too vigorously, its internal valve components can be forced away from the valve body so as to destroy the valve and permit the soft soap to flow unrestrained.

Figure 2:
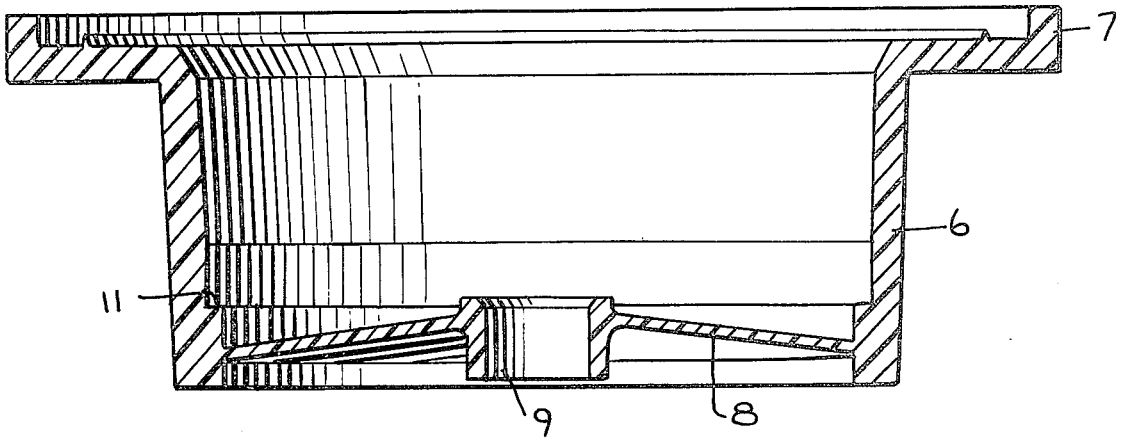
Figure 2A:
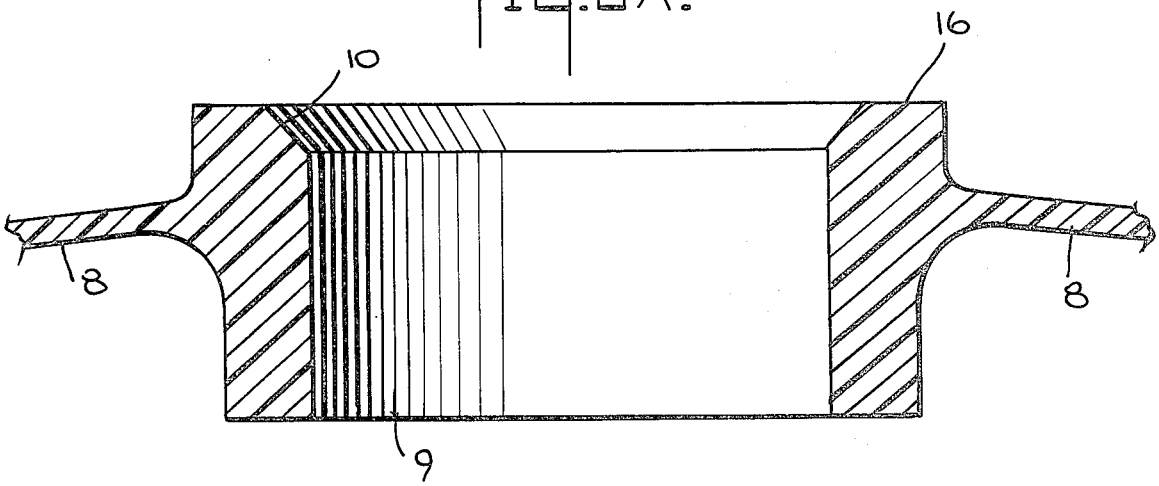

The accompanying drawings are for use in connection with the following detailed description of this new valve, the various figures being as follows:

FIG. 1 is a vertical section showing the new valve applied to the schematically illustrated horizontal portion of the bag;

FIG. 2 in vertical section shows the injection-molded plastic part forming a first part of the valve;

FIG. 2*a* in vertical section shows this part with the diaphragm hole's periphery forming the conical valve seating surface of the patented valve, and is on a substantially enlarged scale;

FIG. 3 in vertical section shows a second part providing the characteristic spokes and wafer of the patented valve;

FIG. 3*a* is a side view showing on an enlarged scale the characteristic wafer of the patented valve, provided by the second part;

FIG. 3*b* is a bottom plan view of FIG. 3; and

Figure 4:
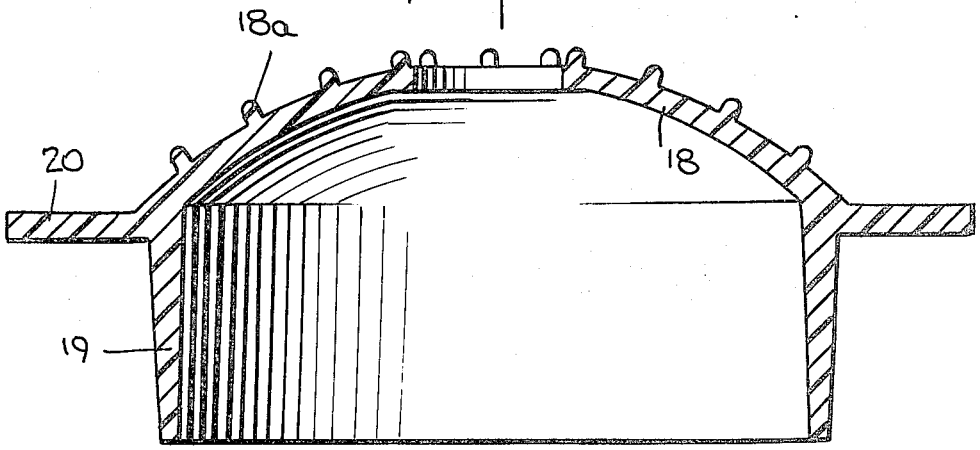

FIG. 4 is a vertical section showing the collapsible dome third part of the new valve.

In the above drawings, in FIG. 1 the horizontal portion of the bag is schematically shown with its mutually adjacent upper wall 1 and lower wall 2, at least the latter resting on a rigid support 3, the lower wall 2 and support 3 forming a hole 5 through which the new valve depends.

The valve has a substantially cylindrical body which includes a first injection-molded plastic molding integrally comprising a cylindrical wall 6 depending from a flange 7 which can be and is shown as being sealed to the inside of the bag's lower wall 2, and forming the diaphragm 8 with its centrally located hole 9 having the upwardly facing conical periphery 10, the inside of the wall 6 being formed with an internal annular solid ledge 11.

A second injection-molded plastic molding integrally forms the wafer 12, its conical periphery 13 facing downwardly and the wafer supported by spokes 14 which extend radially from the wafer with their outer ends encircled by a ring 15 which seats on the solid ledge 11 of the first part. Great resistance to dislodgement is thus provided.

The diaphragm of the first part is formed with flat surfaces 16, or stops, which face upwardly at the edge of the conical surface 10, and the second part at the inner tips of its spokes has downwardly facing flat surfaces 17 at the edge of its wafer, these surfaces on the respective parts abutting when the conical surfaces 10 and 13 substantially precisely mate. In this way the conical surfaces are prevented from wedging together when the conical surface of the diaphragm receives its upward seating force via the diaphragm's elasticity.

A third injection-molded plastic molding integrally provides the dome 18 having upstanding protuberances preventing sticking of the upper wall and with a depending cylindrical wall 19 which fits inside of the wall 6 of the first part, with its lower edge resting on top of the ring 15 of the second part. This third part, in addition, has an external flange 20 which rests on the flange 7 of the first part.

The two conical peripheries are shown as being thin and as mating precisely together, with the wafer periphery surfaces free from any obstruction to the flow of soft soap occurring when the valve is opened. The mating conical surfaces reclose positively and quickly when the pressure is relieved from the diaphragm's top.

Even if the bag upper wall 1 is forced downwardly with great force quickly applied, it is impossible for the valve parts to be dislodged downwardly from the valve body. The rim 15 of the spokes 14 rest solidly on the ledge 11 of the first part providing the cylindrical wall 6 and the wafer 12 is positively positioned by the inner tips of the spokes 14.

We claim:

1. A self-closing dispensing valve for a flexible bag containing a fluid product and having a wall in which a dispensing hole is formed; said valve having a first integral part comprising a first tubular wall having a flange at one end and which flange is adapted to be sealed to the flexible bag wall around the hole with the flange extending radially outwardly from the first tubular wall, the first tubular wall having an outer end closed by an elastically flexible diaphragm having a dispensing hole and inwardly from the diaphragm having an internal shoulder facing away from the diaphragm; a second integral part comprising a valve head positioned so as to close the diaphragm's hole and mounted by spokes extending radially from the valve head to a ring encircling the outer ends of the spokes and with the ring seating on the shoulder of the first tubular wall; and a third integral part comprising a second tubular wall fitting inside of the first tubular wall and having one end seating on the ring of the second integral part and its other end closed by an elastically collapsible dome centrally having a normally open hole.

2. A self-closing metering dispensing valve for a flexible bag containing a fluid product and including a portion having mutually adjacent upper and lower walls with a dispensing hole in the lower wall; said valve comprising a substantially cylindrical body having a flange extending radially from its upper portion and adapted to be sealed to said lower wall around said hole with the body depending therefrom, a circular wafer having a downwardly facing conical periphery and positioned on and normal to the body's axis by spokes connected only to the top of the wafer's periphery and extending radially to and connecting with the inside of the body below its upper portion, an elastically deflectable diaphragm below the wafer and spokes and having an outer periphery connected to the inside of the body and a central hole forming an upwardly facing conical periphery normally seated on the wafer's periphery, and an elastically collapsible dome closing the top of the body and centrally having a normally open hole through which said product can flow, downward displacement of the bag's said upper wall causing it to close the dome's said hole and collapse the dome, said conical peripheries forming substantially mating conical surfaces and the valve having stop means for positively preventing said surfaces from wedging together and said stop means comprising said spokes forming downwardly facing flat surfaces and said diaphragm forming flat upwardly facing flat surfaces, said flat surfaces abutting when said conical peripheries substantially mate; said body including an injection molded plastic molding integrally forming said diaphragm and a substantially cylindrical wall upstanding therefrom and having an internal annular ledge above the diaphragm, said wafer and spokes comprise an injection plastic molding integrally including a ring at the spoke's ends and resting on said ledge, and said dome comprises an injection plastic molding integrally having a depending substantially cylindrical wall telescoped inside of the upstanding substantially cylindrical wall and having a bottom abutting said ring of the second-named molding, at least one of the first-named and third-named moldings having an external flange adapted to be sealed to said lower wall of the bag.

3. The valve of claim 2 in which said dome has upstanding projections adapted to prevent the bag's said upper wall from sticking to the valve's said dome.

* * * * *